US007165431B2

(12) United States Patent
Iida et al.

(10) Patent No.: US 7,165,431 B2
(45) Date of Patent: Jan. 23, 2007

(54) CR-PLATED MANDREL BAR FOR MANUFACTURING HOT SEAMLESS TUBE AND METHOD OF MANUFACTURING THE SAME

(75) Inventors: Sumio Iida, Takarazuka (JP); Toshiro Anraku, Tokyo (JP); Masami Imamura, Hannan (JP); Hirofumi Hori, Kainan (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/291,869

(22) Filed: Dec. 2, 2005

(65) Prior Publication Data

US 2006/0130548 A1 Jun. 22, 2006

Related U.S. Application Data

(63) Continuation of application No. PCT/JP04/07685, filed on Jun. 3, 2004.

(30) Foreign Application Priority Data

Jun. 4, 2003 (JP) ..... 2003-158945

(51) Int. Cl.
*B21B 17/10* (2006.01)
*B21B 25/00* (2006.01)

(52) U.S. Cl. ..... 72/208; 72/466.2

(58) Field of Classification Search ..... 72/208, 72/149, 150, 466.2, 270.04, 370.05, 217, 72/218

See application file for complete search history.

(56) References Cited

U.S. PATENT DOCUMENTS 5,580,845 A * 12/1996 Ruane ..... 508/161

FOREIGN PATENT DOCUMENTS

| | | |
|---|---|---|
| JP | 63-020105 | 1/1988 |
| JP | 04-284905 | 10/1992 |
| JP | 08-071618 | 3/1996 |
| JP | 08-164404 | 6/1996 |
| JP | 11-226614 | 8/1999 |
| JP | 2000-246312 | 9/2000 |
| JP | 2000-351007 | 12/2000 |
| JP | 2000-001016 | 1/2001 |

* cited by examiner

*Primary Examiner*—Dmitry Suhol
(74) *Attorney, Agent, or Firm*—Clark & Brody

(57) ABSTRACT

By employing a Cr-plated mandrel bar for producing hot seamless tubes according to the present invention wherein centerline average roughness Ra in axial and circumferential directions as well as maximum depth Rv in axial and circumferential directions is specified and further maximum height Rp in axial and circumferential is specified, surface defects such as seizure unlikely generate in an elongation-rolling process by a mandrel mill so that the service life can be dramatically extended, thereby the remarkable reduction of tool cost can be achieved. Moreover, it contributes greatly to improve the inner surface quality of hot seamless tubes to be rolled by a mandrel mill rolling process. Also, the manufacturing method by the present invention makes it possible to efficiently manufacture Cr-plated mandrel bar for producing hot seamless tubes.

3 Claims, 4 Drawing Sheets

(a)

(b)

CR-PLATED MANDREL BAR FOR MANUFACTURING HOT SEAMLESS TUBE AND METHOD OF MANUFACTURING THE SAME

CROSS-REFERENCE TO RELATED APPLICATIONS

This application is a continuation of International Patent Application No. PCT/JP2004/007685, filed Jun. 3, 2004. This PCT application was not in English as published under PCT Article 21(2).

FIELD OF THE INVENTION

The present invention relates to a tool for use in producing either hot seamless tubes or pipes (hereinafter, a tube or pipe is referred to as a tube generically) and a method of manufacturing the tool, more particularly to a Cr-plated mandrel bar of which the service life can be extended in a mandrel mill rolling process for a hot seamless tube, and a method of manufacturing said mandrel bar.

BACKGROUND ART

For producing a small size and a mid-size hot seamless tube, a tube-making method by a mandrel mill rolling process is applied.

FIG. 1 is a diagram explaining the outline of the tube-making step by a mandrel mill rolling process. In this tube-making method, a solid round billet 1 as a work material to be rolled being heated to a preset temperature is subjected to a piercing process by a piercing-rolling mill 3 (so-called piercer mill) where the centerline portion thereof is pierced, thus a hollow tube stock 2 is made. Subsequently, the hollow tube stock 2 thus obtained is moved to a mandrel mill 4 where an elongation-rolling process is applied.

In a mandrel mill 4, a plurality of reduction roll pairs 6 to be used for rolling the hollow tube stock 2 where each roll of the pair is set as opposed to each other with respect to a pass line are disposed, and the hollow tube stock 2 is subjected to an elongation-rolling process in which said stock is rolled and elongated by means of the reduction rolls 6 for pressing the outer surface of said tube stock coupled with the mandrel bar 5 inserted into said tube stock. In general, the reduction rolls 6 are housed in the roll stand and each pair of reduction rolls 6 in roll stands lying side-by-side are set with 90° of phase angle, thereby the hollow tube stock 2 is rolled while altering the circumferential direction of reduction rolling by 90° in phase angle at every roll stand.

The mandrel bar 5 to be used for the mandrel mill rolling process is conventionally manufactured from the round bar made of Hot Working Tool Steel such as JIS SKD6 or SKD61. Further, in order to secure the toughness and crack resistance, it is common that the entire body of mandrel bar having smooth surface by polishing is quenched and tempered, thereby the surface hardness is controlled to be HV350–450 or so and the mill scale film is formed over the surface of the mandrel bar.

In the mandrel mill rolling process, in order to avoid the seizure between the hollow tube stock 2 and the mandrel bar 5, a water-soluble lubricant primarily composed of the solid lubricant is coated and dried on the surface of mandrel bar 5 to preform the film of solid lubricant prior to performing elongation-rolling. Besides, when it is necessary to enhance the effect of the lubrication, the solid lubricant is provided onto the inner surface of the hollow tube stock where said lubricant is melted by the heat retained within the hollow tube stock 2, thereby the liquid lubricant film can be preformed.

With the liquid lubricant film thus preformed, the friction force to be generated between the inner surface of the hollow tube stock 2 and the surface of the mandrel bar 5 when an elongation-rolling process is applied and/or the mandrel bar 5 is withdrawn can be reduced, thus the seizure of the hollow tube stock as well as the wear of the mandrel bar 5 can be prevented.

However, as there exists the persistent sliding friction at the interface between the inner surface of the hollow tube stock 2 and the surface of the mandrel bar 5 during an elongation-rolling process, it is hard to maintain a perfect lubrication at the interface between them. Thus, while using the mandrel bar repeatedly, the surface defects such as wear, seizure, rough surface or crack inevitably develop, resulting in ending the service life thereof. Meanwhile, the mandrel bar becoming out of service life is reused as the one with a smaller diameter after machining the outer surface.

In this regard, the tool cost relative to the production cost of a hot seamless tube by a mandrel mill rolling process, especially the expense to be spent for the mandrel bar, is very high. Therefore, for the purpose of reducing the production cost of a hot seamless tube, it has been studied to improve the surface condition which serves to suppress the occurrence of surface defects on the mandrel bar and to extend the service life thereof.

For example, in Japanese Patent Application Publication No. 63-20105 (hereinafter, referred to as a patent document 1), there is proposed a surface conditioning method for reducing the friction coefficient in the mandrel mill rolling process and enhancing the tightness of the mill scale film, wherein the dimples with maximum depth 50 μm are provided on the surface of the mandrel bar at the rate of two or more dimples per 1 mm in length.

Also in Japanese Patent Application Publication No. 04-284905 (hereinafter, referred to as a patent document 2), there is proposed a surface conditioning method for a mandrel bar for use in rolling a hot seamless tube, wherein the surface of the mandrel bar itself is polished in circumferential direction and then the finishing polishing is conducted so as to ensure 4–12 μm of surface roughness Ra in longitudinal direction. Further, in Japanese Patent Application Publication No. 08-164404 (hereinafter, referred to as a patent document 3), there is proposed a mandrel bar for use in rolling a hot seamless tube, specifying the surface roughness in circumferential direction to be 1.0–4.0 μm in centerline average roughness (Ra).

The mandrel bar and the surface conditioning method thereof in above patent documents 1–3 are intended to enhance the tightness of the mill scale film, taken for granted that the mill scale film is formed on the surface.

Thus, an effect regarding the tightness of the mill scale film can be appreciated to some extent in case of the mandrel bar according to the patent documents 1–3. Nonetheless, even if the surface conditioning as proposed were conducted on the mandrel bar, the surface layer of the mandrel bar should be exposed to the high temperature of 500–600° C. during an elongation-rolling process so that the oxidization-decarburization on the surface layer of the bar should take place and cause the softening of the surface layer. The mandrel bar with such a softened surface layer causes the seizure even if the mill scale film were formed. Therefore, it is not possible to fully expect the extension of the service life of the mandrel bar by merely forming the mill scale film thereon.

As described above, there exists a certain limit in extending the service life of the mandrel bar in case of forming the mill scale film. So, a mandrel bar on which a Cr-plated hard film is formed to enhance the wear resistance is recently utilized. Namely, by forming a thick Cr-plated layer of as much as 50 μm, the direct contact of the oxygen in air with the surface of the substrate is eliminated, thus preventing the oxidation-decarburization.

FIG. 2 is a diagram comparing the service life of the mandrel bar in case that a stainless steel is subjected to a mandrel mill rolling process. The service life of the Cr-plated mandrel bar is normalized to the service life of the mandrel bar having the mill scale film formed, i.e. the service life of the mandrel bar having the mill scale film formed is rated as 1. For a reference, the grades of the stainless steel that are used for tube-making are SUS420J1 and the like.

The service life of the Cr-plated mandrel bar is remarkably extended in comparison with that having the mill scale film formed, whereas it is extended by a factor of five in average, although depending on the tube size to be made, the material grade, and especially the amount of thickness reduction.

Normally, to employ a Cr-plated mandrel bar, it becomes necessary to install a plating equipment as an initial investment, but a running cost onwards becomes equivalent to that for the conventional mandrel bar having the mill scale film formed. Thus, the Cr-plated mandrel bar becomes a primary target in respect of the campaign of extending the service life which serving for reduction of the production cost.

In this aspect, several proposals for extending the service life of a Cr-plated mandrel bar are offered further. For example, in Japanese Patent Application Publication No. 08-71618 (hereinafter, referred to as a patent document 4), there is proposed a mandrel bar having a Cr-plated film with centerline average roughness (Ra) of 1.0–4.0 μm in axial direction, and in Japanese Patent Application Publication No. 2000-246312 (hereinafter, referred to as a patent document 5), there is proposed a mandrel bar having a Cr-plated film with centerline average roughness (Ra) of 0.1 μm or more but below 1.0 μm in axial direction.

Further, in Japanese Patent Application Publication No. 2001-1016 (hereinafter, referred to as a patent document 6), there is made a proposal on a mandrel bar having a Cr-plated film with a thickness of 60–200 μm, and in Japanese Patent Application Publication No. 2000-351007 (hereinafter, referred to as a patent document 7), there is made a proposal on a mandrel bar wherein the waviness of the surface in length-wise direction is specified.

In the mandrel bar proposed in above patent documents 4–7, taken granted that Cr-plating is performed, the service life can be extended as expected. However, the demand for reducing further the production cost of a hot seamless tube in a mandrel mill rolling process is so strong, and in particular the tool cost reduction is mostly concerned among others. In such a circumstance, a further dramatic improvement in respect of the extension of the service life of the mandrel bar is demanded.

SUMMARY OF THE INVENTION

The present invention is made to comply with the foregoing demand for extension of the service life of the mandrel bar, and its object is to provide a Cr-plated mandrel bar for use in tube-making of a hot seamless tube which makes it possible to suppress the occurrence of the surface defects, resulting in the remarkable extension of the service life thereof, when a seamless tube is made by an elongation-rolling process using a mandrel mill, as well as a method for manufacturing said mandrel bar.

The present inventors have precisely studied how the surface condition of the mandrel bar affects on the service life thereof, in order to address above problems and to accomplish the extension of the service life of the mandrel bar.

To be concrete, the service life of the mandrel bar being proposed in the patent document 4 wherein the surface condition thereof is conspicuously distinguished, is compared with that of the mandrel bar being proposed in the patent document 5. Namely, the mandrel bar by cited patent 4 has a Cr-plated film of 1.0–4.0 μm in centerline average roughness (Ra) in axial direction, while the mandrel bar by the patent document 5 has a Cr-plated film of 0.1 μm or more but below 1.0 μm in centerline average roughness (Ra) in axial direction.

As a result of comparison of their service life, there is no significant difference between them, although the mandrel bar by the patent document 4 has a little longer service life. Namely, despite the conspicuous difference in the surface condition, it is perceived that there is no notable significance in difference between them with respect to the service life.

To look into the unexpected result above, the present inventors intentionally interrupted and stopped the rolling operation halfway through in the mandrel mill rolling process and precisely scrutinized the remaining lubricant on the mandrel bar for each case. The lubricant in use is made in such a way that the water-soluble lubricant primarily composed of graphite (for example, one disclosed in Japanese Patent Publication No. 59-37317) is coated and dried.

FIG. 3 is a diagram showing the remaining lubricant on the mandrel bar halfway through the mandrel mill rolling process, whereas (a) shows the remaining lubricant in case the mandrel bar was checked in longitudinal direction, and whereas (b) shows the remaining lubricant in case the mandrel bar seen in the direction from X—X arrow in (a) was checked in circumferential direction. As described above, the reduction roll pairs where each roll of the pair is set as opposed to each other is disposed in a manner that the rolling direction of said roll pair in the roll stand is alternated by 90° of phase angle in the mandrel mill rolling process, thereby the rolling operation is conducted while changing the rolling region by 90° of phase angle at each roll stand. Thus, as shown in FIGS. 3(*a*) and 3(*b*), the rolling region 7 and the lubricant remaining region 8 (slant line area) alternate the circumferential direction by 90° of phase angle at each roll stand along the rolling direction.

In the halfway of rolling operation, the amount of remaining lubricant on the mandrel bar by the patent document 4 having a Cr-plated film of 1.0–4.0 μm in centerline average roughness (Ra) in axial direction was more abundant than that on the mandrel bar by the patent document 5 having a Cr-plated film of 0.1 μm or more but below 1.0 μm in centerline average roughness (Ra) in axial direction, while the difference was very small.

Next, in the lubricant remaining region 8 shown in FIG. 3(*a*), it was observed that an abundant lubricant remained not only at the longitudinal side edge 8*a* but also at the circumferential side edge 8*b*, implying that the lubricant on the surface of the mandrel bar 5 was mobilized not only in longitudinal rolling direction but in circumferential rolling direction.

In other words, although it was easily anticipated that the lubricant should be mobilized in longitudinal rolling direction where the elongation rate in rolling was high, it was found that the lubricant was also mobilized in circumferential rolling direction where the elongation rate is significantly low compared to longitudinal rolling.

Based on these findings, it can be understood why there was no significance in difference with respect to the service life even if there were notable difference on the surface condition between the mandrel bar by the patent document 4 and the one by the patent document 5.

Namely, in order to prevent the seizure of the mandrel bar, it becomes necessary to have the lubricant remained on its surface during rolling and it is not sufficient enough to specify the surface condition of the mandrel bar in one direction only. For example, in case a polishing process is applied for controlling the surface roughness, when the surface roughness in the direction in parallel with polishing direction happened to become too fine and smooth, although the surface roughness in the direction orthogonal to polishing direction should be adequate, the lubricant during rolling do not remain there. Thus, the seizure and the like likely generate on the surface of the mandrel bar, thereby the extension of the service life cannot be expected.

The present invention is consummated based on these findings and its gist is encapsulated in (1) a Cr-plated mandrel bar for use in producing a hot seamless tube and (2) a method for manufacturing said mandrel bar in the followings.

(1) A Cr-plated mandrel bar for use in producing a hot seamless tube, comprising 1.0–5.0 μm in centerline average roughness Ra in axial and circumferential directions and also 10 μm or more in maximum depth Rv in axial and circumferential directions.

The Cr-plated mandrel bar above further preferably comprises 30 μm or less in maximum height Rp in axial and circumferential directions.

(2) A method for manufacturing the Cr-plated mandrel bar for use in producing a hot seamless tube, comprising the steps of forming a Cr-plated film on said mandrel bar surface of which centerline average roughness Ra in axial and circumferential directions is 1.0–5.0 μm and maximum depth Rv in axial and circumferential directions is 10 μm or more, and polishing the surface subsequently.

"Maximum depth Rv" specified in the present invention designates the distance from the deepest valley to the mean line within the range of sampling length in surface roughness profile shown in FIG. 5, and "maximum height Rp" similarly designates the distance from the highest peak to the mean line within the range of sampling length in said profile.

As the polishing step by the invention, "light polishing" can be adopted. Herein, "light polishing" designates the treatment that makes "maximum height Rp" only to be reduced without affecting "maximum depth Rv" so much, for example, polishing by using a sand paper with abrasive grain size finer than #280 is exemplified.

BEST MODE FOR CARRYING OUT THE INVENTION

The mandrel bar by the present invention is characterized in that said bar comprises 1.0–5.0 μm of centerline average roughness Ra in axial and circumferential directions and 10 μm or more of maximum depth Rv in axial and circumferential directions. The reason why the surface condition in axial and circumferential directions is specified is that, in order to make the lubricant to sufficiently be remained on the surface during an elongation-rolling process, it is not enough to specify it in one direction only on the mandrel bar, thus becoming necessary to specify in both axial and circumferential directions.

Figure 1:
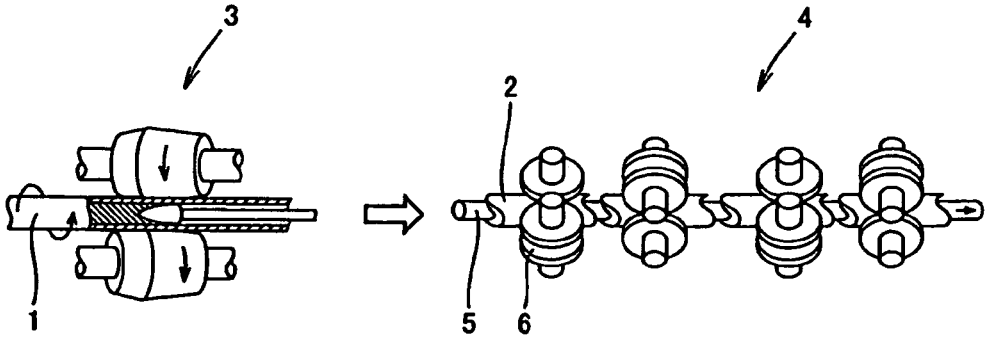
FIG. 1 is a diagram explaining the outline of tube-making step by a mandrel mill rolling process.
Figure 2:
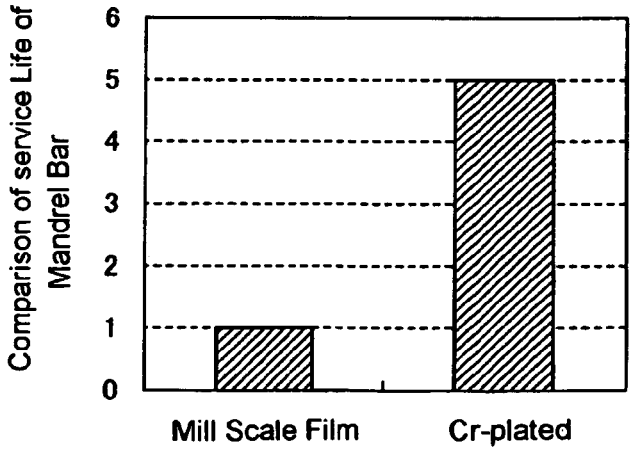
FIG. 2 is a diagram comparing the service life of the mandrel bar in case that a stainless steel is subjected to a mandrel mill rolling process.
Figure 3:
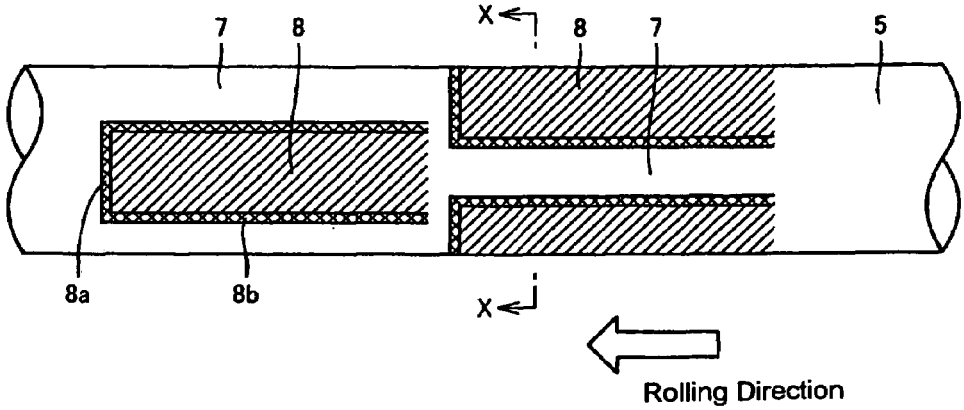
FIG. 3 is a diagram showing the remaining lubricant on the mandrel bar halfway through the mandrel mill rolling process, whereas (a) shows the remaining lubricant in case the mandrel bar is checked in longitudinal direction, and whereas (b) shows the remaining lubricant in case the mandrel bar seen in the direction from X—X arrow in (a) is checked in circumferential direction.
Figure 3:
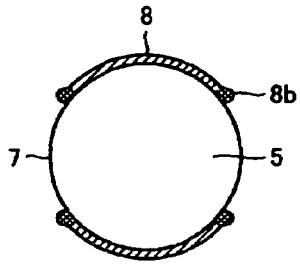
Figure 4:
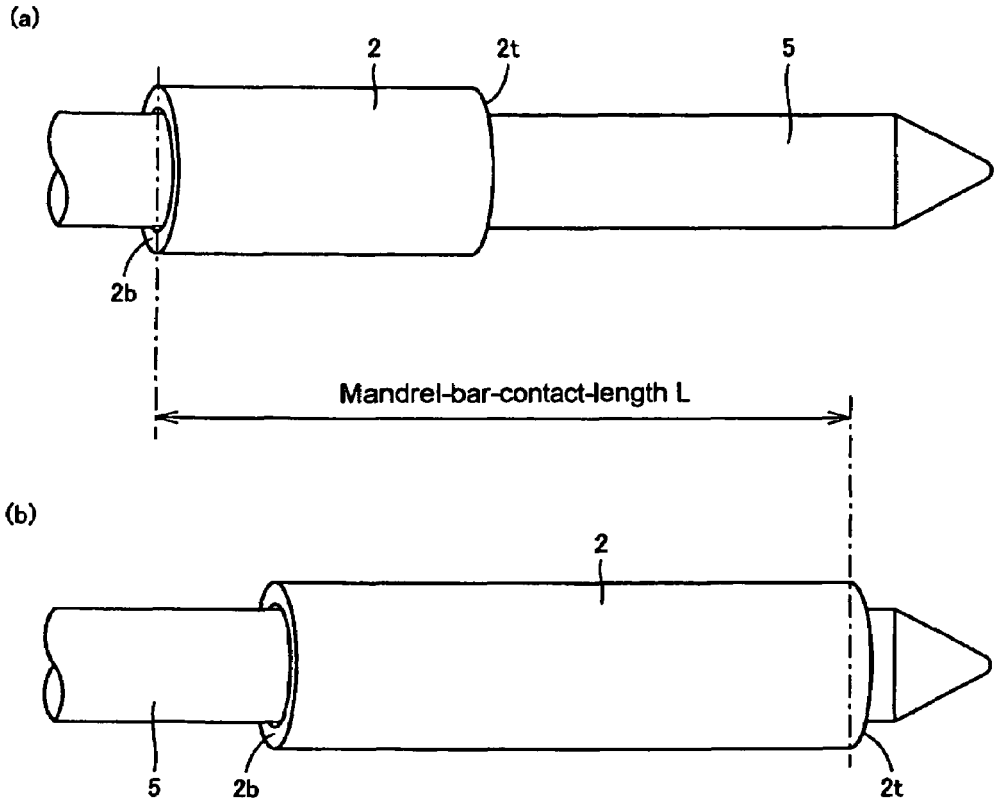
FIG. 4 is a diagram explaining a region in which the surface condition (Ra, Rv) of the mandrel bar is specified, whereas (a) shows a configuration before rolling, and whereas (b) shows a configuration after rolling.
Figure 5:
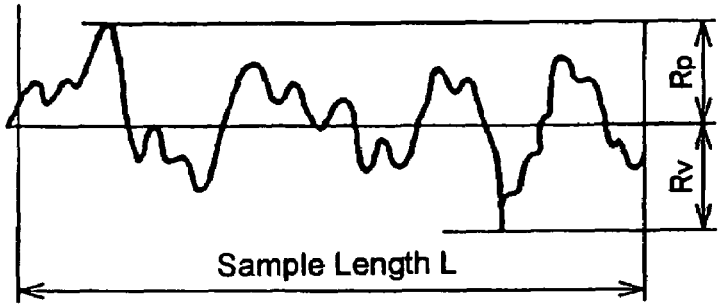
FIG. 5 is a diagram explaining "maximum depth Rv" and "maximum height Rp" which are specified in the present invention.

FIG. 4 is a diagram explaining a region in which the surface condition (Ra, Rv) of the mandrel bar is specified, whereas (a) shows a configuration before rolling, and whereas (b) shows a configuration after rolling. The region in concern encompasses the entire length as well as the whole circumference where the mandrel bar 5 makes close contact with the in-processing work material during rolling.

To be concrete, the entire length as well as the whole circumference over the mandrel-bar-contact-length L which ranges from the bottom end 2*b* of the work material 2 in the state as shown in FIG. 4(*a*) that the mandrel bar 5 is inserted into said work material 2 just before rolling, to the top end 2*t* of the in-processing work material after rolling as shown in FIG. 4(*b*). The region in concern, for example, can be specified so that two positions are selected per each spot at every 90 degree in circumferential direction for each lengthwise location apportioned at the pitch of 1 m for roughness profile measurement, and the average value of measured data is defined as the surface condition (Ra, Rv) of the mandrel bar.

The remaining lubricant during rolling is affected by centerline average roughness Ra as well as maximum depth Rv in respect of the surface roughness profile for the mandrel bar. First of all, it is essential that centerline average roughness shall be within the range of 1.0–5.0 μm. Namely, in case that Ra is less than 1 μm either in axial direction or circumferential direction, the lubricant retention efficacy in relevant direction is lowered, resulting in loss of the lubricant on the mandrel. On the other hand, in case that Ra should exceed 5.0 μm, the seizure generates due to the protruded spots on the surface, thus reducing the service life of the mandrel bar.

Concurrently, it is required that maximum depth Rv from the mean line shall be 10 μm or more in axial and circumferential directions. In case that maximum depth Rv is too small, it is not possible to secure the depth which enables to retain the lubricant, and the concave spot/valley should disappear earlier, thus reducing the lubricant retention efficacy to end up in loss of the lubricant. Meanwhile, the upper limit of maximum depth Rv is not set forth, but preferably to be 50 μm or less.

In the present invention, both centerline average roughness Ra and maximum depth Rv significantly affect the lubricant retention efficacy for leaving the lubricant in place, i.e., the lubricant repository pool, while the function contributing to the lubricant repository pool is different from each other. To be concrete, centerline average roughness Ra is an index representing the volume of the lubricant repository pool, while maximum depth Rv can be considered to be an index of the depth of the lubricant repository pool.

Figure 6:
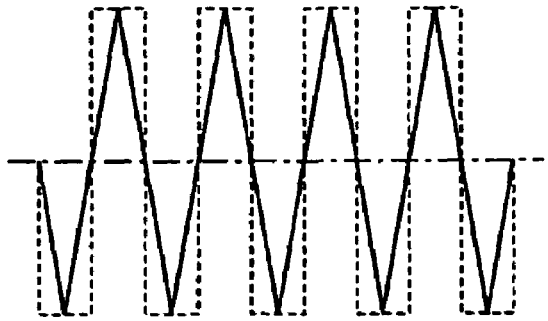
FIG. 6 is a diagram explaining how differently centerline average roughness Ra associates with the lubricant repository pool comparing to maximum depth Rv.
Figure 7:
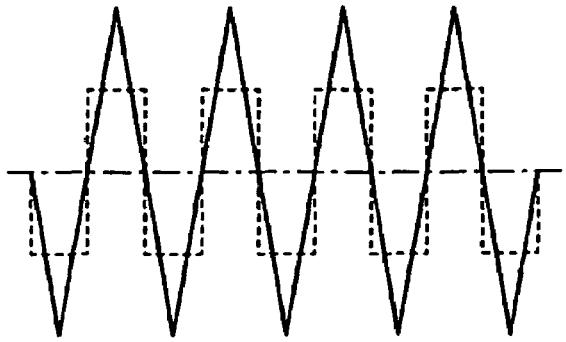
FIG. 7 is a diagram, similarly to FIG. 6, explaining how differently centerline average roughness Ra associates with the lubricant repository pool comparing to maximum depth Rv.

FIGS. 6 and 7 are diagrams explaining how differently centerline average roughness Ra associates with the lubricant repository pool comparing to maximum depth Rv. The solid and dotted lines schematically represent the roughness profile on the surface of the mandrel bar respectively.

The solid line and the dotted line in FIG. 6 indicate the same maximum depth Rv from the mean line, but centerline average roughness Ra in case of the dotted line is much larger, which implies that the volume of lubricant repository pool is larger. On the contrary, the solid line indicates that the volume of lubricant repository pool is smaller, thus it is suspected that the lubricant cannot be sufficiently retained.

The solid line and the dotted line in FIG. 7 indicate the same centerline average roughness Ra, but maximum depth Rv from the mean line in case of the solid line is much larger, which implies that the depth of lubricant repository pool is larger. On the contrary, the dotted line indicates that the depth of lubricant repository pool is smaller, thus it is suspected that the concave spot/valley should disappear earlier and the lubricant retention efficacy should be lowered.

Therefore, in order to make the lubricant stay in place during rolling, it is required to maintain not only the volume of the lubricant repository pool but also the depth of said pool. To that end, centerline average roughness Ra indicating the volume of said pool as well as maximum depth Rv indicating the depth of said pool are required to meet above conditions simultaneously.

Further, in the mandrel bar by the present invention, even if the lubricant repository pool is sufficiently secured in such a way that centerline average roughness Ra as well as maximum depth Rv, either in axial and circumferential directions, is controlled properly within the specified range, there exists the case that the service life cannot be extended due to the factor that the protruded spots being present on the surface likely induces the seizure when maximum height Rp from the mean line is large enough.

In order to avoid this kind of circumstances, it is preferable to control maximum height Rp from the mean line in axial and circumferential directions to be 30 μm or less.

When the mandrel bar by the present invention is manufactured, any surface treatment among shot-blasting, grinding, polishing, masking-etching, laser treatment and the like can be applied only if the surface condition in axial and circumferential directions were controlled so that centerline average Ra as well as maximum depth Rv specified above should fall within the proper range. Although it is admitted that, among them, the simplest and most effective surface treatment is shot-blasting, there is a matter to be taken care of in applying it as the surface treatment of the mandrel bar.

First of all, centerline average roughness Ra in axial and circumferential directions, before shot-blasting shall be smaller than the intended centerline average roughness Ra after shot-blasting. When shot-blasting is applied for the mandrel bar, the surface layer is scraped off, thus the control of surface roughness before shot-blasting is very important, although it seems that surface roughness before shot-blasting will not affect surface roughness after shot-blasting.

For example, when shot-blasting is performed after circumferential grinding or polishing, centerline average roughness Ra in axial direction should fall within the proper range, but there occurs an occasion that centerline average in circumferential direction should deviate from the proper range. This is because, although it seems that whole surface is shot-blasted, the concave spot/valley formed during grinding or polishing will not be reached by the blasting grit with sufficient energy, thus the shot-blasting effect can not be fully expected there.

In this regard, it is required that centerline average roughness Ra in both axial and circumferential directions prior to shot-blasting shall be smaller than the intended centerline average roughness Ra after shot-blasting. To be concrete, it is generally appreciated as the method for the shot-blasting process that shot-blasting is performed after polishing by using a belter (belt-type polishing apparatus) or the like.

Next, it is required that the nozzle-to-surface distance from the nozzle of blasting machine to the surface of the mandrel bar shall be controlled to be within the proper range. Said nozzle is often brought closer to the surface in order to secure the grinding efficacy, but the uniform distribution of the grit during blasting is not achieved when the nozzle-to-surface distance is too close, thus likely resulting in obtaining Ra in axial direction that is different from Ra in circumferential direction. Consequently, either centerline average roughness Ra in axial direction or the one in circumferential direction is obliged to deviate from the proper range specified.

Therefore, it is necessary to control the nozzle-to-surface distance within the proper range. For example, in the present invention, when shot-blasting with the fixed nozzle is applied for the mandrel bar that is moving ahead while rotating, the blasting parameters can comprise (1) the steel grit: 0.1–0.4 mm in average grain size and HRC55 or more in hardness, (2) blasting pressure: 35–40 MPa, and (3) nozzle-to-surface distance: 150–300 mm. However, the parameters exemplified above is relevant for the mandrel bar made of Hot Working Tool Steel (SKD6 or SKD61) with Hs: 45–55 or so in hardness, and the proper range for the nozzle-to-surface distance should vary in accordance with the material grade and hardness of the work material to be blasted. In this regard, the proper range of nozzle-to-surface distance shall be determined duly in accordance with the other parameters for shot-blasting.

Further, the surface roughness of the plated film after Cr-plating treatment can be controlled by adjusting the surface roughness of the mandrel bar prior to said plating. Generally, after Cr-plating, the surface roughness tends to slightly get rougher than that of the substrate material. Taking this into consideration, centerline average roughness Ra and maximum depth Rv, either in axial and circumferential directions, further maximum height in both axial and circumferential directions, when in need, are required to be adjusted prior to applying Cr-plating treatment for the mandrel bar.

In the manufacturing method by the present invention, neither the method of Cr-plating treatment nor the parameters thereof are limited, thus any common treatment method and the parameters can be applied. For example, in considering the aspect of close adhesion onto the base metal of the mandrel bar, it is preferable to apply an electroplating treatment with the parameters similar to the ones for treatment of general machinery parts.

In case that maximum height Rp from the mean line on the surface of the inventive mandrel bar thus manufactured is 30 μm or more, it is effective to apply light polishing for the surface. As one of the parameter of said light polishing, polishing by use of a sand paper with abrasive grain size finer than #280 is exemplified.

EXAMPLES

The effect of the mandrel bar by the present invention was checked in a commercial tube-making and rolling process. The mandrel bar in use was SKD61 specified in JIS Standard, and the dimension thereof comprises 200–450 mm in diameter and 24 m in length, whereby the number of rolling before reaching the service life thereof, i.e., how many times it was used to mature the service life, was investigated. Whether the service life is over or not is judged based on the presence of the seizure on the surface of the mandrel bar, whereby the surface defects, seemingly gouged, with open aperture to be detected by visual observation is sentenced to the seizure. The depth of the relevant defects was as much as 200 μm among the shallow ones, and deep ones occasionally got to 1 mm in depth.

The used mandrel bar was ground and polished to the preset dimension, and then shot-blasting was applied, followed by Cr-plating of 50 μm thick film. In the surface treatment of the mandrel bar, polishing is applied for finishing the surface roughness prior to shot-blasting so as to be 0.5 μm or less in centerline average roughness Ra in both axial and circumferential directions.

The steel grits of five grades designated by S1–S5 of which the grain size is different from each other (in average grain size, S1: 0.1 mm, S2: 0.15 mm, S3: 0.23 mm, S4: 0.36 mm, and S5: 0.7 mm) and of which the hardness is HRC55 or more were used for shot-blasting, along with the parameters such as the blasting pressure of 35–40 MPa and the nozzle-to-surface distance of 150–450 mm. The surface roughness (Ra) before shot-blasting and the shot-blasting parameters in EXAMPLES are shown in Table 1.

TABLE 1

| | Test No. | Surface Roughness Before Shot-Blasting Ra (μm) Axial Direction | Circumferential Direction | Shot-blasting Parameters Designation | Blasting Pressure (Mpa) | Nozzle-To-Surface Distance (mm) |
|---|---|---|---|---|---|---|
| Inventive Example | 1 | 0.5 | 0.5 | S1 | 35–40 | 150–250 |
| | 2 | 0.4 | 0.5 | S2 | 35–40 | 150–250 |
| | 3 | 0.5 | 0.4 | S3 | 35–40 | 150–250 |
| | 4 | 0.4 | 0.5 | S4 | 35–40 | 150–250 |
| Comparative Example | 5 | 0.5 | 0.4 | — | — | — |
| | 6 | 3.6 | 0.7 | — | — | — |
| | 7 | 3.5 | 0.7 | S4 | 35–40 | 150–250 |
| | 8 | 0.5 | 0.4 | S1 | 35–40 | 350–450 |
| | 9 | 0.4 | 0.5 | S5 | 35–40 | 150–250 |

In the Inventive Example Nos. 1–3, Cr-plating was applied after shot-blasting. In the Inventive Example No. 4, Cr-plating was applied after shot-blasting process, and then polishing was applied as a finishing process by use of a sand paper with #400 abrasive grain size.

On the other hand, in Comparative Example No. 5, the surface was finished by use of a sand paper with #400 abrasive grain size, while pressing with the force of 5 N, and then Cr-plating was applied. In Comparative Example No. 6, polishing in circumferential direction was applied, followed by Cr-plating. In Comparative Example No. 7, polishing in circumferential direction was applied, and then shot-blasting was carried out, followed by Cr-plating. In Comparative Example Nos. 8 and 9, after shot-blasting, Cr-plating was applied.

The result of rolling by use of the mandrel bar by Inventive Example Nos. 1–4 as well as Comparative Example Nos. 5–9 is shown in Table 2.

TABLE 2

| | Test No. | Surface Condition of Mandrel Bar: Ra (μm) Axial Direction | Ra (μm) Circumferential Direction | Rv (μm) Axial Direction | Rv (μm) Circumferential Direction | Rp (μm) Axial Direction | Rp (μm) Circumferential Direction | Result of Rolling: Service Life (pieces) | Evaluation |
|---|---|---|---|---|---|---|---|---|---|
| Inventive Example | 1 | 1.2 | 1.3 | 15 | 16 | 13 | 12 | 1258 | ◎ |
| | 2 | 3.3 | 3.1 | 24 | 26 | 22 | 21 | 1496 | ◎ |
| | 3 | 4.4 | 4.1 | 33 | 30 | 21 | 23 | 1686 | ◎ |
| | 4 | 4.5 | 4.3 | 36 | 33 | *38 | *37 | 1079 | ○ |
| Comparative Example | 5 | **0.6 | **0.5 | **3 | **4 | 5 | 4 | 654 | X |
| | 6 | 3.5 | **0.6 | 21 | 8 | 25 | 9 | 657 | X |
| | 7 | 2.1 | **0.8 | 31 | 11 | 27 | 15 | 752 | X |
| | 8 | 1.2 | 1.3 | **8 | **7 | 10 | 9 | 865 | X |
| | 9 | **5.6 | **5.5 | 46 | 44 | *48 | *45 | 353 | X |

Note)

The symbol ** prefixed to the number in the Table indicates the deviation from the proper range specified by the present invention, and the symbol * likewise indicates the preferable limitation is not satisfied.

From the result shown in Table 1, in Inventive Examples that satisfied the specified Ra as well as Rv, either in axial and circumferential directions, by the present invention, the service life in either case turned out to be 1000 pieces or more of rolled tube stock, thus the extension of the service life was achieved. In Inventive examples 1–3 that maximum height Rp in axial and circumferential directions is 30 m or less, the service life became 1200 pieces or more of rolled tube stock, thus much further extension of the service life was achieved.

On the contrary, in Comparative Examples wherein one of the surface conditions deviated from the specified range by the present invention, the service life in either case fell short of 1000 pieces of rolled tube stock, thus it was not possible to extend the service life.

INDUSTRIAL APPLICABILITY

By adopting a Cr-plated mandrel bar for use in producing a hot seamless tube according to the present invention, wherein centerline average roughness Ra in axial and circumferential direction as well as maximum depth Rv in axial and circumferential direction is specified, and wherein maximum height Rp in axial and circumferential directions is further specified, the occurrence of the surface defects such as seizure is unlikely in an elongation-rolling process by a mandrel mill, and the service life can be dramatically extended, thereby the remarkable reduction of tool cost can be achieved. Moreover, a great contribution to improve the inner surface quality of a hot seamless tube to be rolled by a mandrel mill rolling process can be expected.

Therefore, the manufacturing method by the present invention makes it possible to provide said Cr-plated mandrel bar for use in producing the hot seamless tube with low production cost and with high efficiency, thus being able to be widely applied in the field of producing the hot seamless tube.

What is claimed is:

1. A Cr-plated mandrel bar for use in producing a hot seamless tube (a tube refers to a tube or pipe generically), a Cr-plated film of said Cr-plated mandrel bar comprising:

1.0–5.0 μm in centerline average roughness Ra in axial and circumferential directions; and 10 μm or more in maximum depth Rv in axial and circumferential directions.

2. A Cr-plated mandrel bar for use in producing a hot seamless tube according to claim 1, wherein the Cr-plated film further comprises 30 μm or less in maximum height Rp in axial and circumferential directions.

3. A method of manufacturing said Cr-plated mandrel bar for use in producing a hot seamless tube, comprising the steps of:

forming a Cr-plated film on a mandrel bar surface of which centerline average roughness Ra in axial and circumferential directions is 1.0–5.0 μm and also maximum depth Rv in axial and circumferential directions is 10 μm or more; and polishing the surface subsequently.

* * * * *